US006082770A

United States Patent [19]

Lin

[11] Patent Number: 6,082,770

[45] Date of Patent: Jul. 4, 2000

[54] FASTENING DEVICE FOR SCHEDULE FOLDER COVERS

[76] Inventor: Jack K. L. Lin, No. 6, Lane 109, Che-Lu-Tou St., San-Chung city, Taiwan

[21] Appl. No.: 09/362,065

[22] Filed: Jul. 28, 1999

[30] Foreign Application Priority Data

Dec. 11, 1998 [TW] Taiwan ..... 87220670

[51] Int. Cl.[7] ..... B42D 3/00

[52] U.S. Cl. ..... 281/29; 281/20; 281/37; 281/45; 402/70; 402/73; 283/36

[58] Field of Search ..... 281/20, 29, 37, 281/45; 402/70, 73; 283/36

[56] References Cited

U.S. PATENT DOCUMENTS

| | | | |
|---|---|---|---|
| D. 352,309 | 11/1994 | Gresham et al. | D19/27 |
| 1,047,792 | 12/1912 | Gresser . | |
| 1,105,506 | 7/1914 | Gearhart . | |
| 1,150,750 | 8/1915 | Eckelmeyer . | |
| 1,711,161 | 4/1929 | Trussell . | |
| 2,252,783 | 8/1941 | Potts et al. . | |
| 2,774,615 | 12/1956 | Joseph . | |
| 5,273,319 | 12/1993 | Lee | 281/29 |
| 5,370,419 | 12/1994 | Takayama | 281/31 |
| 5,433,480 | 7/1995 | Gresham et al. | 281/17 |
| 5,897,141 | 4/1999 | Dugmore et al. | 281/20 |
| 5,908,258 | 6/1999 | Boccacci | 402/70 |

*Primary Examiner*—Willmon Fridie, Jr.
*Assistant Examiner*—Alisa L. Thurston
*Attorney, Agent, or Firm*—Bacon & Thomas, PLLC

[57] ABSTRACT

A fastening device for schedule folder covers with a side plate to join two covers of schedule folder, wherein both ends of the side plate is connected with a side chain band similar to a metallic watchband and identical to the width thereof, and a connecting zipper fitted to both sides of the side chain band and the edge of the covers, and wherein a closed state between two covers and the side chain band is created by means of the connecting zipper while a soft parting member can be mounted inside of the side chain band, if necessary, for dividing the internal space of the folder in accordance with the using requirements and for enhancing the flexible using of the whole internal space.

6 Claims, 5 Drawing Sheets

FASTENING DEVICE FOR SCHEDULE FOLDER COVERS

BACKGROUND OF THE INVENTION

1. Field of the Invention

The present invention relates to a fastening device for schedule folder covers, and more particularly to a folder with a side plate to connect two hard covers, wherein a firm and close connection can be achieved.

2. Description of the Prior Art

With the development of the modern life, people demand more on the time planning, so that all kinds of notebooks, memo books, calendar books etc. have been broadly used. Due to the high life standard in the modem time, beautiful, practical and convenient notebooks are required. Therefore, the suppliers have been trying their best to develop all kinds of notebooks with different outlines and materials to meet the above-mentioned requirements. Furthermore, an appropriate closure (even a locking device) is necessary to maintain the personal privacy in the modern time.

The conventional fastening device for notebooks and folders is zipper which is however only used for covers with soft materials. Besides, the quality needs to be proved after the assembly thereof, so that it can be only applied to products with lower requirements. On the other hand, another fastening device (or connecting band) fitted to the side cover is also well-known, wherein the fastening device (or connecting band) is joined to the other fastening member on the other cover through clamping, engaging, etc method. However, this method is only applicable to notebooks or folders with hard covers. In addition, such fastening device has the fastening device (or connecting band) uneasy for assembly (e.g. on the metallic cover), and the assembly of the whole body is also not firmly fixed and easy to break. All of these result in using disadvantages. Moreover, cover plates are pivoted to both sides of the side plate, so that at least one side of the connecting side plate must have a clearance with the width of the side plate in closing these two covers. Thus, a zipper can't be applied thereto for connection.

SUMMARY OF THE INVENTION

It is the main object of the present invention to provide a fastening device for schedule folder covers, wherein both ends of the side plate is connected with a side chain band similar to a metallic watchband and identical to the width thereof, and a connecting zipper fitted to both sides of the side chain band and the edge of the covers, and wherein a closed state among two covers and the side chain band is achieved by means of the connecting zipper.

It is another object of the present invention to provide a fastening device for schedule folder covers, wherein a soft parting member can be mounted inside of the side chain band, if necessary, for dividing the internal space of the folder in accordance with the using requirements and for enhancing a flexible use of the whole internal space.

It is a further object of the present invention to provide a fastening device for schedule folder covers, wherein a internal parting plate is pivoted to the internal side of the cover, and wherein by making use of an engaging push button to control the opening of internal parting plate, the room between the internal parting plate and the cover can be used for accommodating name cards, changes, etc.

BRIEF DESCRIPTION OF THE DRAWINGS

The drawings disclose illustrative embodiments of the present invention which serves to exemplify the various advantages and objects hereof, and are as follows.

DETAILED DESCRIPTION OF THE PREFERRED EMBODIMENT

Figure 1:
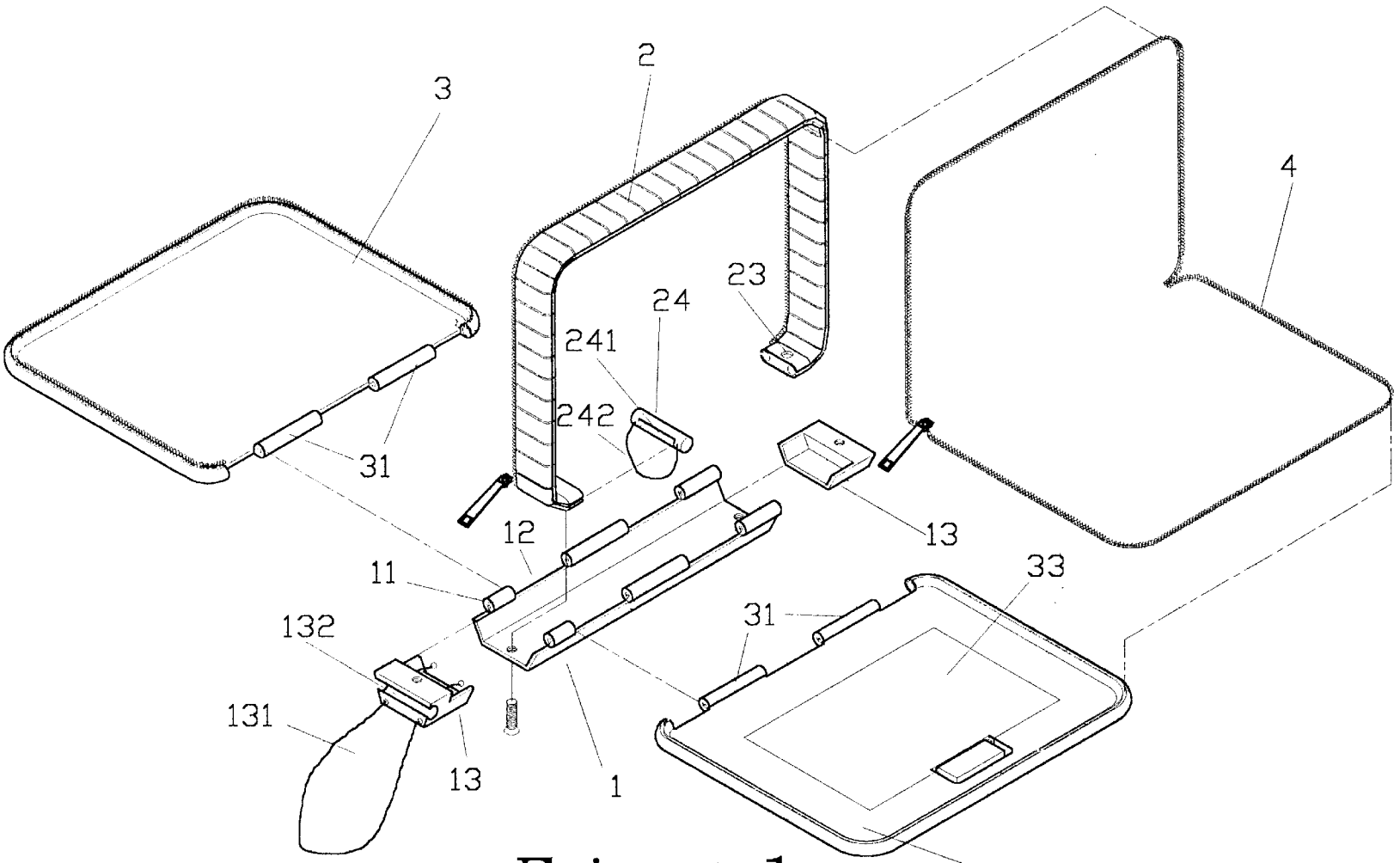
FIG. 1 is an exploded view of the present invention.
Figure 2:
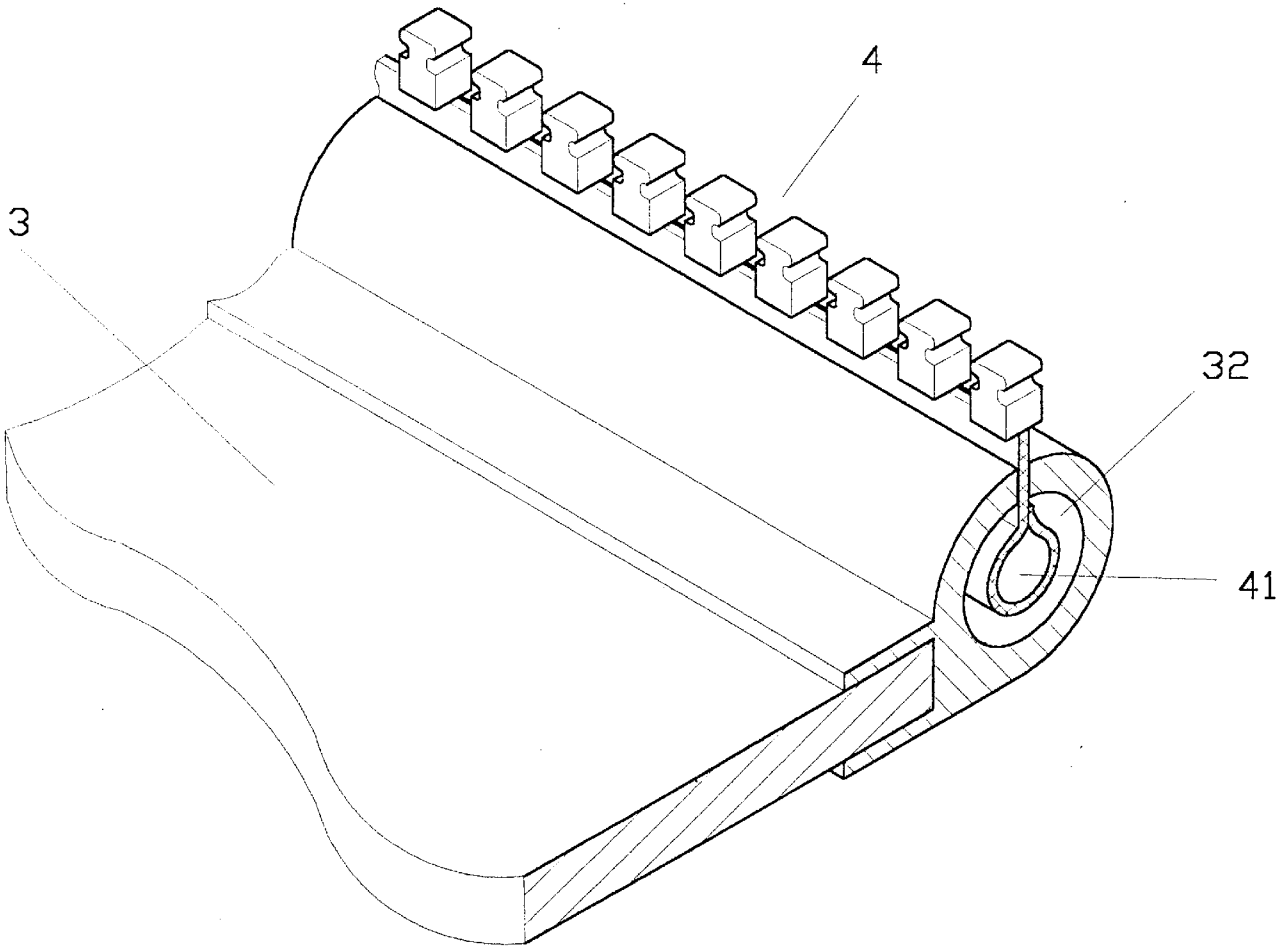
FIG. 2 shows a schematic connection between the connecting zipper and the covers in accordance with the present invention.
Figure 3A:
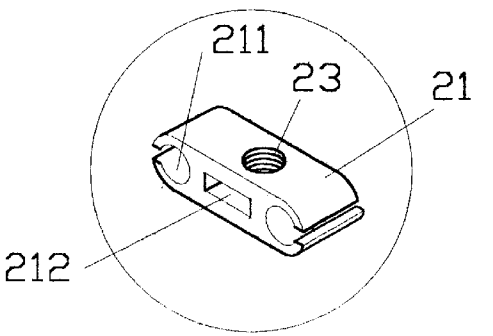
FIG. 3A is an enlarged perspective view of one of the links shown in FIG. 3.
Figure 3:
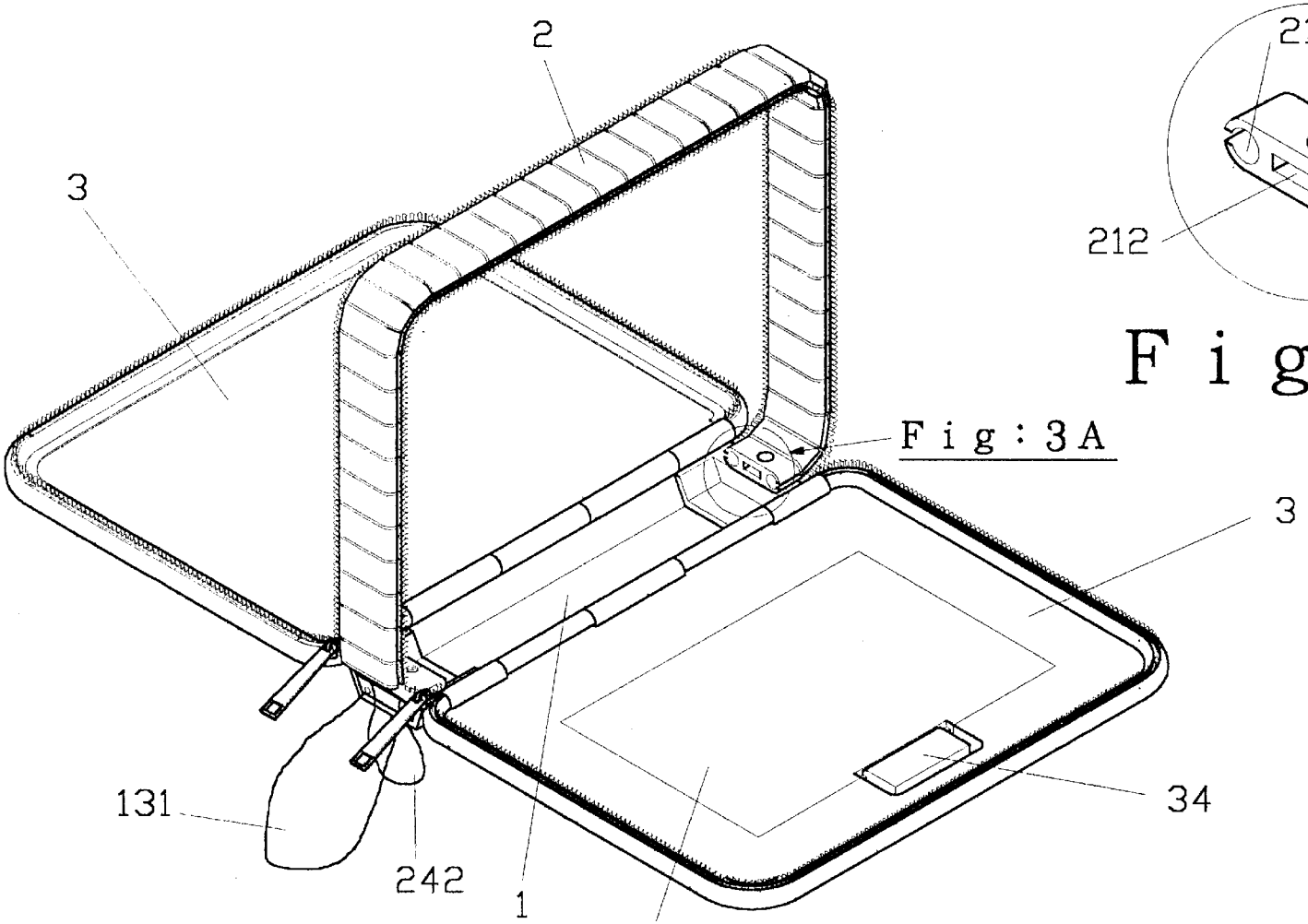
FIG. 3 is a perspective view of the present invention.

First of all, referring to FIGS. 1 through 3, the present invention mainly includes a side plate 1, a side chain band 2, two covers 3 and a connecting zipper 4, wherein the long strip-shaped side plate 1 is provided with a number of axle holders 11 separated one another with intermediate grooves 12, and wherein the both ends of the side plate 1 can be respectively connected with a clamping member 13 one of which at least is fitted with a bar-shaped slotted rail 132 from which a hanging band 131 elongates outwards for an easier holding. The side chain band 2 comprises a number of links 21 each of which is provided with a long hole 212 in the middle thereof for inserting a connecting band, so that a flexible band body like metallic watchband is created. A through hole 23 is disposed at one end of the side chain band 2 for joining the clamping member 13 and the side plate 1 together by means of a screw so as to fasten the end thereof. The other end thereof elongates into a long hole 241 connected to an engaging bar 24 provided with a pull band 242 extending outwards. The both sides of the side chain band 2 are respectively fitted with an inward slotted hole 211 with narrow opening. A number of outwards protruding axle holders 31 are mounted on one side of the cover 3 and are installable in the intermediate grooves 12 to create a connection with the axle holders 11 by means that an appropriate axle is inserted among them. Accordingly, the two covers 3 can be pivoted at both sides of the side plate 1. The edge of the covers 3 is provided with a slotted hole 32 with a narrow opening while an internal parting plate 33 is pivoted to the bottom face thereof so as to create a clamping room between the internal parting plate 33 and the cover 3. Besides, a protruding member 331 is fitted to the other side thereof for an engaging push button 34 pivoted at the side to connect therewith into a slotted clamping member 341. The connecting zipper 4 is provided with an expansion base 41 at the bottom end of the both sides thereof which can be placed into the slotted hole 211 of the side chain band 2 and the slotted hole 32 of the cover 3, so that the side chain band 2 and the cover 3 can be joined with the connecting zipper 4 together.

In assembling the present invention, one end of the side chain band 2 and the clamping member 13 are fixed at one end of the side plate 1 while the clamping member 13 with the bar-shaped slotted rail 132 is fixed at the other end thereof. Thereafter, the engaging bar 24 connected to the other end of the side chain band 2 is engaged into the bar-shaped slotted rail 132 in position. Accordingly, both ends of the side chain band 2 are protected by the clamping member 13 so as to beautify the external appearance. The covers are pivoted to both sides of the side plate 1 and are connected with each other by means of the connecting zipper 4. In coordination with the flexibility of the side chain band 2, a smooth connection between the covers and the side chain band 2 can be achieved. Therefore, an accommodation of the schedule folder is created among the side plate 1, the side chain band 2 and the covers 3.

Figure 4:
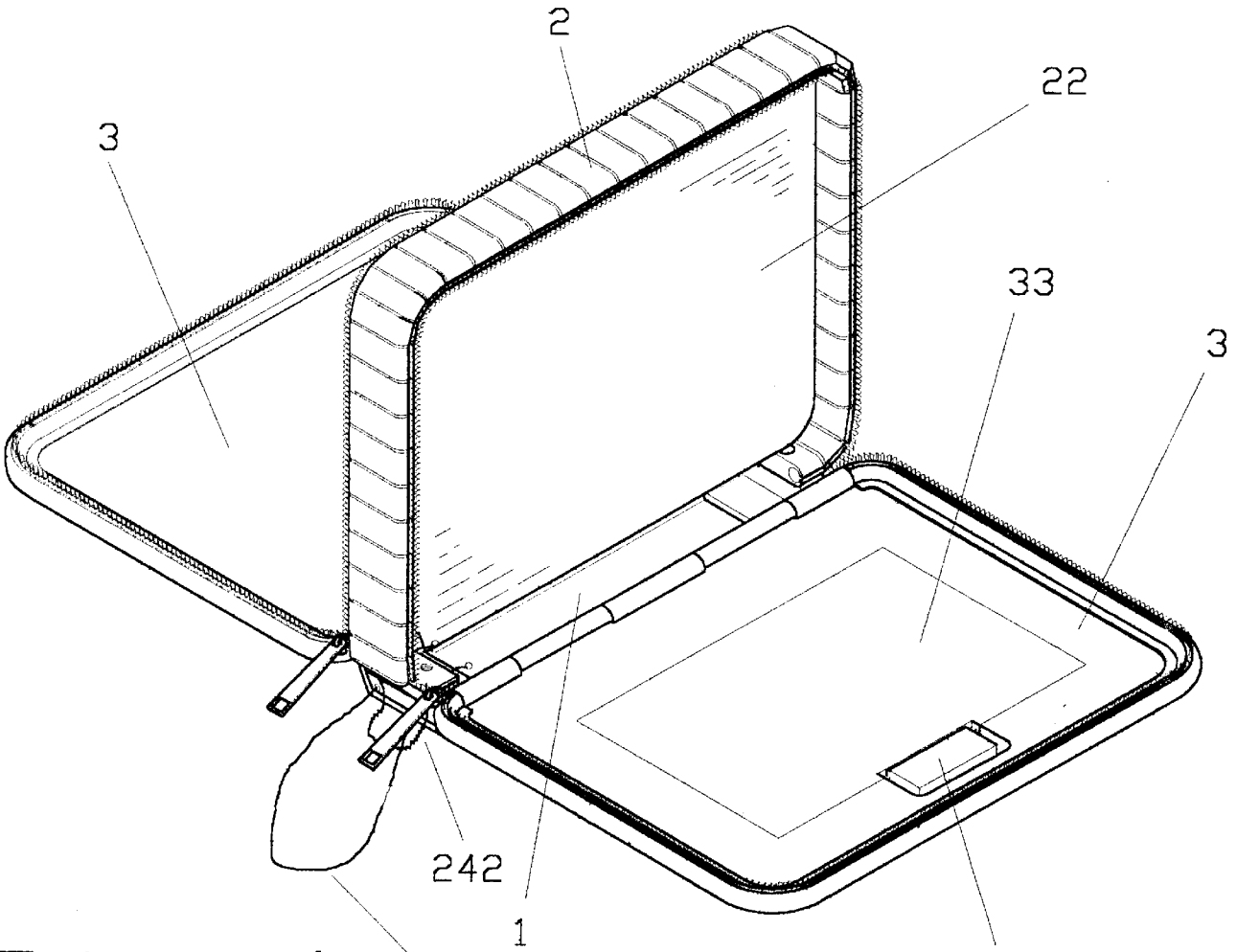
FIG. 4 shows another preferred embodiment of the present invention.

FIG. 4 shows another preferred embodiment of the present invention, wherein a soft parting member 22 is disposed inside of the side chain band 2. It is used for effectively parting the internal room of the schedule folder without influencing the movement of the side chain band 2, so that the schedule folder can be used more flexibly and variably.

The pull band 242 in accordance with the present invention is used for pulling the engaging bar 24 to be separate from the bar-shaped slotted rail 132 of the clamping member 13. When it's not smooth to pull the connecting zipper 4 between the side chain band 2 and the covers 3, the pull band 242 can serve for a proper removal of this difficulty.

Figure 6:
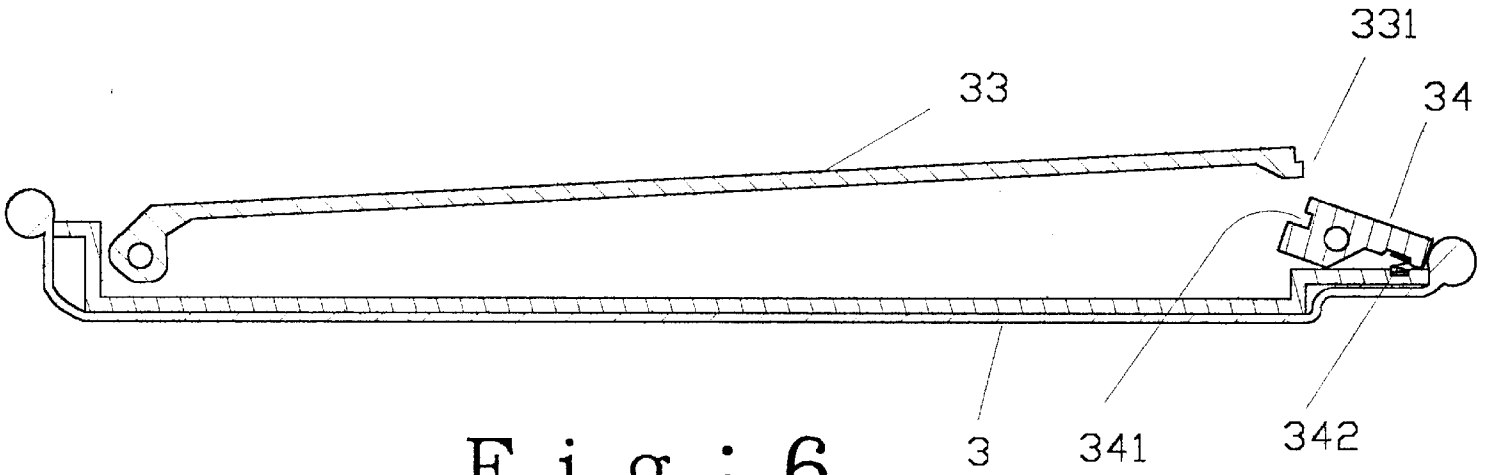
FIG. 6 shows a second schematic drawing of the engaging push button in accordance with the present invention in controlling the internal parting plate to open and to close.
Figure 5:
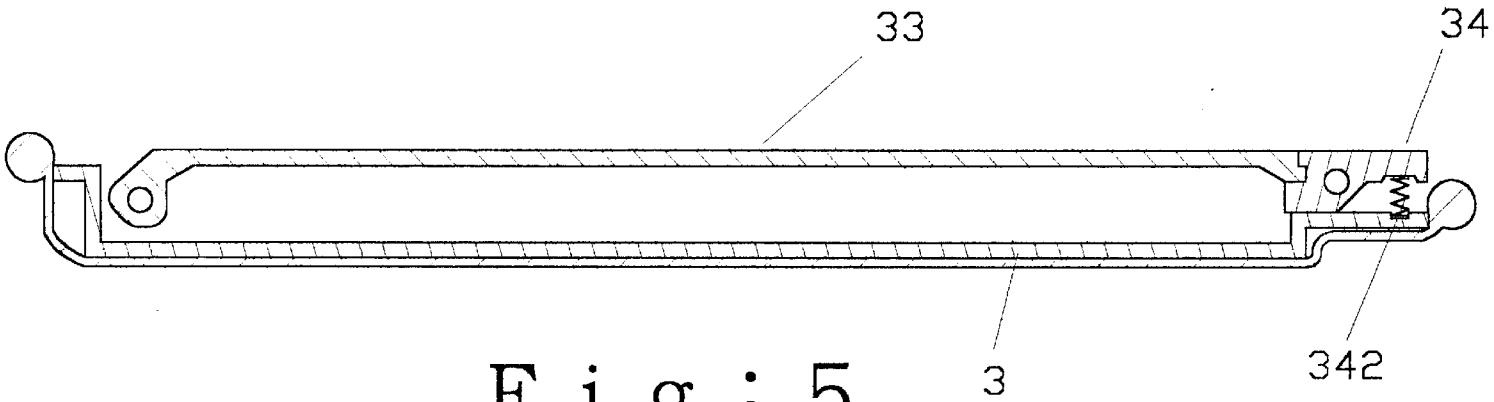
FIG. 5 shows a first schematic drawing of the engaging push button in accordance with the present invention in controlling the internal parting plate to open and to close.

FIGS. 5 and 6 shows a schematic drawing of the engaging push button in accordance with the present invention in controlling the internal parting plate to open and to close. When it is situated in a closed state, the engaging push button 34 is pushed by a spring 342 to let the slotted clamping member 341 be engaged into the protruding member 331 of the internal parting plate 33, so that the internal parting plate 33 is positioned and can't be opened, as shown in FIG. 5. After pushing the engaging push button 34, one end of the slotted clamping member 341 is directed upwards and the slotted clamping member 341 will also be slid upwards to separate from the protruding member 331 of the internal parting plate 33. Therefore, the internal parting plate 33 is situated in an open state, as shown in FIG. 6. By making use of the engaging push button 34 to control the opening of internal parting plate 33, the room between the internal parting plate 33 and the cover 3 can be used for accommodating name cards, changes, etc.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A fastening device for schedule folder covers comprising:

a side plate with a long strip-shaped outline whose both sides are provided with a number of axle holders separated from one another between intermediate grooves, and the both ends thereof can be connected with two clamping members one of which at least is fitted with a lateral bar-shaped slotted rail at the external side end thereof;

a side chain band with a number of links each of which is provided with a long hole into which a connecting band is inserted to form a hard flexible band body similar to a metallic watchband, and a inwards elongating slotted hole with narrow opening fitted to both sides thereof respectively, and a through hole mounted to one end of the side chain band for joining said clamping member to be fixed on one end of the side plate together, and an engaging bar connected to one end thereof and engaging into the bar-shaped slotted rail of another clamping member for positioning it at another end thereof;

a number of covers with several outwards protruding axle holders at one side thereof extending into said intermediate grooves to achieve a connection with said axle holders, so that both sides of said side plate can be pivoted together, and a slotted hole with narrow opening mounted to the edge thereof;

a connecting zipper with an expansion base at the bottom end of both sides, wherein said connecting zipper can be respectively placed into both sides of said side chain band and said slotted hole at the edge of said cover to join said side chain band and said covers therewith; characterized in that said covers are pivoted to both sides of said side plate by means that both ends of said side chain band are fixed at both ends of said side plate, and that an closed accommodating room for schedule folder is formed among said side plate, said side chain band and said covers by means of said connecting zipper in coordination with the flexible feature of said side chain band.

2. The fastening device for schedule folder covers of claim 1, wherein a parting member is disposed inside of the side chain band for dividing the internal space so as to achieve a more flexible and variable use of the whole body.

3. The fastening device for schedule folder covers of claim 1, wherein an outwards extending pull band is fitted to both ends of said engaging bar for facilitating the separation of said engaging bar from said bar-shaped slotted rail of said clamping member.

4. The fastening device for schedule folder covers of claim 1, wherein an outwards extending hanging band can be fitted to said clamping member to facilitate the holding.

5. The fastening device for schedule folder covers of claims 1, wherein an internal parting plate is pivoted to one side of the bottom end of said cover while an engaging push button is disposed at the other side to control the opening and closing thereof, so that an openable and closeable clamping room between said internal parting plate and said cover is created.

6. The fastening device for schedule folder covers of claim 1, wherein the connection between said internal parting plate and said engaging push button is achieved by means that the protruding member and the slotted clamping member join with each other.

* * * * *